US008555846B2

(12) United States Patent
Bode et al.

(10) Patent No.: US 8,555,846 B2
(45) Date of Patent: Oct. 15, 2013

(54) AIR PURIFIER HAVING RESONATOR INSTALLED IN THE AIR OUTLET

(75) Inventors: Burkhard Bode, Osterspai (DE); Torsten Lang, Budenheim (DE)

(73) Assignee: GM Global Technology Operations LLC, Detroit, MI (US)

( * ) Notice: Subject to any disclaimer, the term of this patent is extended or adjusted under 35 U.S.C. 154(b) by 203 days.

(21) Appl. No.: 13/090,572

(22) Filed: Apr. 20, 2011

(65) Prior Publication Data

US 2011/0253090 A1 Oct. 20, 2011

(30) Foreign Application Priority Data

Apr. 20, 2010 (DE) ..... 10 2010 015 541

(51) Int. Cl.
*F02M 35/10* (2006.01)

(52) U.S. Cl.
USPC ..... 123/184.57; 123/184.21; 123/184.61; 181/228

(58) Field of Classification Search
USPC ..... 123/184.57, 184.21, 184.61, 198 E; 181/228
See application file for complete search history.

(56) References Cited

U.S. PATENT DOCUMENTS

| | | | | | |
|---|---|---|---|---|---|
| 3,402,881 | A | * | 9/1968 | Moore et al. | 415/47 |
| 4,446,824 | A | | 5/1984 | Endo et al. | |
| 4,713,097 | A | | 12/1987 | Grawi et al. | |
| 4,730,864 | A | * | 3/1988 | Sample | 294/50.9 |
| 4,782,912 | A | * | 11/1988 | Wandless | 181/229 |
| 4,790,864 | A | * | 12/1988 | Kostun | 96/388 |
| 5,059,221 | A | * | 10/1991 | McWilliam | 96/380 |
| 5,106,397 | A | | 4/1992 | Jaroszczyk et al. | |
| 5,900,595 | A | * | 5/1999 | Akima et al. | 181/229 |
| 5,913,295 | A | * | 6/1999 | Sadr et al. | 123/198 E |
| 6,048,386 | A | * | 4/2000 | Gillingham et al. | 96/384 |
| 6,247,442 | B1 | * | 6/2001 | Bedard et al. | 123/198 E |
| 6,578,650 | B2 | * | 6/2003 | Ozawa et al. | 180/68.1 |
| 6,898,289 | B2 | * | 5/2005 | Vanderveen et al. | 381/71.4 |
| 7,143,736 | B2 | * | 12/2006 | Jessberger et al. | 123/198 E |
| 7,383,810 | B1 | * | 6/2008 | Emley | 123/198 E |
| 2005/0235615 | A1 | | 10/2005 | Nyman et al. | |
| 2007/0000467 | A1 | | 1/2007 | Shaw et al. | |

FOREIGN PATENT DOCUMENTS

| | | | |
|---|---|---|---|
| DE | 3007851 | A1 | 9/1980 |
| DE | 10243883 | A1 | 4/2004 |
| EP | 0280430 | A2 | 8/1988 |
| JP | 10037820 | A | 2/1998 |
| JP | 10331732 | A | 12/1998 |
| JP | 11082204 | A | 3/1999 |

OTHER PUBLICATIONS

German Patent Office, German Search Report for German Application No. 102010015541.1, dated Jan. 17, 2011.
British Patent Office, British Search Report for Application No. 1103252.1, dated Jun. 21, 2011.

* cited by examiner

*Primary Examiner* — Noah Kamen
*Assistant Examiner* — Long T Tran
(74) *Attorney, Agent, or Firm* — Ingrassia Fisher & Lorenz, P.C.

(57) ABSTRACT

An intake system is provided for an internal combustion engine, which includes, but is not limited to an air purifier/resonator configuration, in which a resonator element is situated in the purified air area of the intake system as an integral component in the air outlet of the air purifier, coaxially to the air outlet.

18 Claims, 2 Drawing Sheets

AIR PURIFIER HAVING RESONATOR INSTALLED IN THE AIR OUTLET

CROSS-REFERENCE TO RELATED APPLICATION

This application claims priority to German Patent Application No. 102010015541.1, filed Apr. 20, 2010, which is incorporated herein by reference in its entirety.

TECHNICAL FIELD

The technical field relates to a combination of air purifier and resonator element for noise damping in internal combustion engines. In particular, the technical field relates to air purifier/resonator configurations, in which a resonator is installed and situated in the air outlet of the air purifier in such a manner that it is oriented coaxially to the air outlet.

BACKGROUND

During operation of internal combustion engines, the fuel is combusted during the combustion procedure with supply of air. The air is supplied to the internal combustion engine via an intake system, which removes particles from the air, which is to be supplied to the internal combustion engine, with the aid of a filter. Noises arise during operation of an internal combustion engine, for example, due to non-continuous air supply. Reducing intake air variations of an intake system of internal combustion engines by adjusting the diameter and length of the intake duct, for example, an intake pipe, and the volume of the air filter, or by adding a resonator to the intake system is known.

Various resonator elements may be used to reduce the noise emission of an internal combustion engine, which may be situated in the unpurified air area or in the purified air area of the intake system, which is separated by one or more air filters from the unpurified air area. In particular if the resonator is situated in the purified air area of the intake system, high requirements are placed on the seal and the fastening of the resonator element. For these reasons, resonator elements are welded to the purified air line in the purified air area of the intake system.

A plurality of intake systems having various resonator configurations is known from the prior art. However, resonators welded onto an air inlet pipe can block the accesses in an engine compartment which are necessary for installation of the internal combustion engine and can thus make assembly more difficult.

Accordingly, at least one object is to provide an intake system for internal combustion engines which is particularly compact. In addition, other objects, desirable features and characteristics will become apparent from the subsequent summary and detailed description, and the appended claims, taken in conjunction with the accompanying drawings and this background.

SUMMARY

An intake system is provided that comprises an air purifier/resonator configuration, in which a resonator element is situated as a noise damper in the purified air area of the intake system as an integral component in the air outlet of the air purifier coaxially to the air outlet. The advantage of an integration of the resonator element in the air outlet of the air purifier allows the usage of the entire length of the air outlet or the entire length between air filter and purified air inlet of the engine or a turbocharger to compensate for the engine movement. Through the device, the noise emission during operation of an internal combustion engine, in particular due to hissing noises during intake of the air, can be prevented or at least reduced. In addition, the resonator does not block any spaces or accesses which are required for the assembly of internal combustion engine and vehicle body in passenger automobiles.

BRIEF DESCRIPTION OF THE DRAWINGS

The present invention will hereinafter be described in conjunction with the following drawing figures, wherein like numerals denote like elements, and.

DETAILED DESCRIPTION

Figure 1:
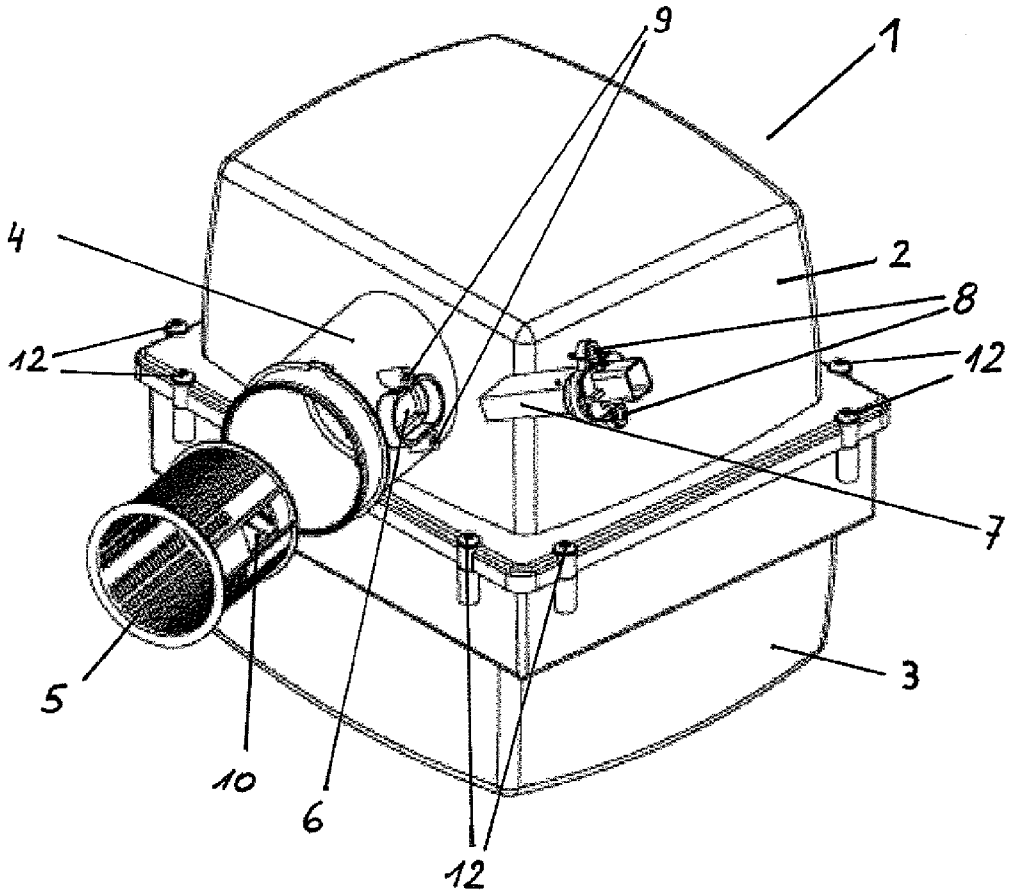
FIG. 1 shows an exemplary embodiment of the air purifier/resonator configuration as an exploded view.

The following detailed description is merely exemplary in nature and is not intended to limit application and uses. Furthermore, there is no intention to be bound by any theory presented in the preceding background or summary or the following detailed description.

The air purifier comprises a housing, which has at least one air outlet in which the resonator element is situated. Furthermore, the housing has at least one air inlet via which the unpurified air is supplied to the air purifier. An air filter is situated inside the housing, which removes particles contained in the unpurified air from the air. The filtered purified air can leave the air purifier via the air outlet and can be supplied to the internal combustion engine or a turbocharger.

The housing for the air filter or filters comprises two or more housing parts, which are removably connected to one another by fastening elements, in preferred embodiments. In a preferred embodiment, the housing therefore comprises at least one first housing part and one second housing part, optionally also further housing parts, which are removably connected to one another. For example, screws, clasps, or clamps come into consideration as the fastening elements for the removable connection of the housing parts to one another. Access to the air filter situated in the housing is made possible by embodiments in which the housing comprises two or more housing parts which are removably connected to one another, so that a replacement of the air filter is made easier.

The housing parts are connected to one another leak-tight, so that air flowing through the intake system cannot escape outward from the housing. Seals can be provided between the housing parts for this purpose, which ensure the tightness of the housing. The housing or one of the housing parts of the air purifier has an air outlet. This air outlet is situated in the form of a pipe or nozzle on the housing or a housing part. In preferred embodiments, the air outlet of the intake system is an integral component of the housing or the housing part.

The pipe or the nozzle of the air outlet can fundamentally have any arbitrary cross-sectional shape. The pipe or the nozzle of the air outlet preferably has a circular cross-section. One embodiment is the resonator element, which can be inserted as an insert into the air outlet.

In an embodiment, the resonator element is provided in the form of a pipe, which has the same cross-sectional shape as the air outlet. The wall of the resonator element has openings whose number, size, and configuration are selected in such a manner that the resonator element functions as a damper for hissing noises in particular. The shape and the size of resonator element and air outlet are adapted to one another in such a manner that the resonator element is insertable into the air outlet and can be held in a friction-locked or formfitting manner in the air outlet. Through the insertion of the resonator element into the air outlet, the resonator element is situated or oriented coaxially to the air outlet. The resonator element becomes an integral component in the air outlet of the air purifier in this manner.

In an embodiment, the intake system has a sensor, which measures the velocity or the mass of the air which flows through the air outlet. The air flow meter or the air mass meter can be introduced through an opening in the wall of the air outlet into the air outlet and, by fastening on the wall of the air outlet, can be positioned in the flow path thereof. For this purpose, the air outlet has an opening for introducing a sensor into the air outlet.

In this embodiment, in which a sensor is situated in the flow path of the air in the air outlet, the resonator element has an opening or a passage in its wall, through which the sensor can be introduced into the air outlet and positioned in the flow path when the resonator element is inserted. The opening in the wall of the resonator element for the passage of the sensor and the cross-section of the sensor in the area which is introduced into the air outlet preferably have the same shape, in relation to the cross-section of the sensor in this area, the opening in the wall of the resonator element being somewhat larger than the cross-section of the sensor in this area.

The intake system is distinguished by a particularly compact design, in which a separate resonator attached to the air outlet does not obstruct the installation of the intake system or an internal combustion engine having the intake system into the engine compartment of a passenger automobile, for example.

Therefore, embodiments also relate to the use of the intake system to produce internal combustion engines and to produce passenger automobiles, which have the intake system or an internal combustion engine having this intake system.

One embodiment is therefore internal combustion engines which have an intake system according to previously mention embodiments. A further embodiment is passenger automobiles which have an intake system according to the embodiments or an internal combustion engine having an intake system according to the embodiments.

The embodiments are explained in greater detail hereafter with reference to the figures. It is to be considered in this case that the figures and exemplary embodiments only have descriptive character and are not intended for the purpose of restricting the invention in any way.

FIG. 1 shows an embodiment of the intake system according to an embodiment, comprising an air purifier/resonator configuration. The air purifier 1 comprises a first housing part 2 and a second housing part 3, which are connected to one another in a leak-tight manner and enclose at least one air filter. The first housing part 2 and the second housing part 3 are connected to one another by screws 12 as fastening elements. An air outlet 4 is situated on the first housing part 2, which is connectable to the purified air inlet of an engine or a turbocharger and through which the filtered purified air flows out of the housing.

The air outlet 4 has an opening 6, through which a sensor 7, preferably an air mass meter, can be introduced into the air outlet 4. The sensor can be fastened on the air outlet 4 with the aid of screws, which are screwed into core holes 9, with which the air outlet 4 is provided. The resonator element 5 can be inserted into the air outlet 4. The resonator element 5 has an opening 10 as a passage for the sensor 7, so that the sensor 7 can also be introduced into the air outlet 4 when the resonator element 5 is inserted.

Figure 2:
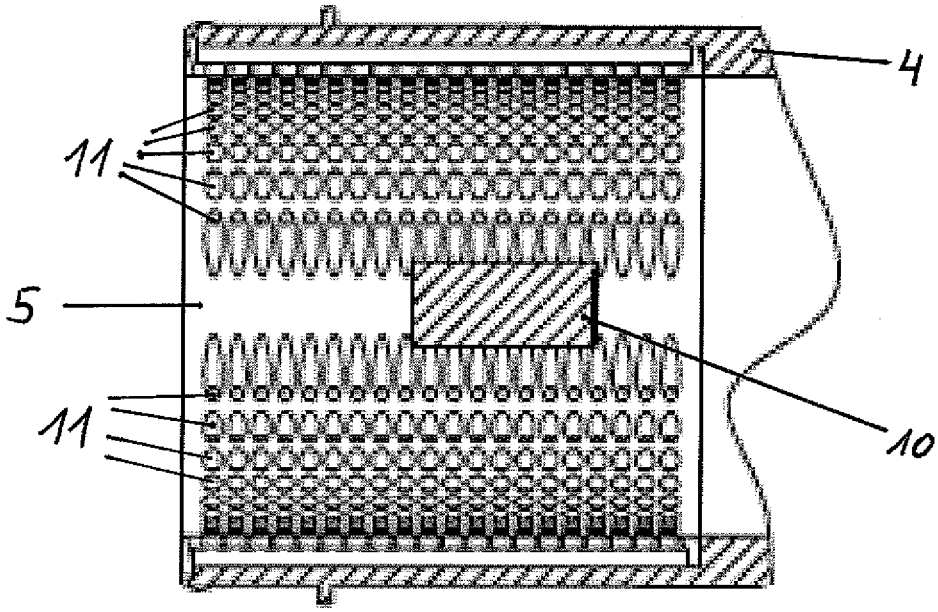
FIG. 2 shows a detail of an exemplary embodiment of the air purifier/resonator configuration in longitudinal section.

FIG. 2 shows a detail of an exemplary embodiment of the air purifier/resonator configuration, in which the resonator element 5 is inserted into the air outlet 4 and is thus oriented coaxially. The resonator element 5 has a passage 10 for a sensor. In addition, the wall of the resonator element has multiple rows, which run parallel to one another, having openings 11.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. An intake system for an internal combustion engine, comprising:
- an air purifier including an air outlet;
- a purified air area of the air purifier; and
- a resonator element situated in, and arranged coaxially to, the air outlet.

2. The intake system according to claim 1, wherein the air purifier comprises a housing including a second air outlet.

3. The intake system according to claim 2, wherein the housing comprises:
- a first housing part; and
- a second housing part removable connected to the first housing part.

4. The intake system according to claim 1, wherein the air outlet has an opening configured to receive a sensor.

5. The intake system according to claim 1, wherein the resonator element is configured for insertion into the air outlet.

6. The intake system according to claim 1, wherein the resonator element is friction-locked into the air outlet.

7. The intake system according to claim 1, wherein the resonator element is form-fitted into the air outlet.

8. The intake system according to claim 1, wherein the resonator element includes a passage configured to receive a sensor.

9. The intake system according to claim 1, further comprising a sensor introduced through the air outlet and the resonator element into a flow path of the air outlet.

10. An automobile, comprising:
- an internal combustion engine; and
- an air intake for the internal combustion engine; the air intake comprising:
  - an air purifier including an air outlet;
  - a purified air area of the air purifier; and
  - a resonator element situated in, and arranged coaxially to, the air outlet.

11. The automobile according to claim 10, wherein the air purifier comprises a housing including a second air outlet.

12. The automobile according to claim 11, wherein the housing comprises:
- a first housing part; and
- a second housing part removable connected to the first housing part.

13. The automobile according to claim 10, wherein the air outlet has an opening configured to receive a sensor.

14. The automobile according to claim 10, wherein the resonator element is configured for insertion into the air outlet.

15. The automobile according to claim 10, wherein the resonator element is friction-locked into the air outlet.

16. The automobile according to claim 10, wherein the resonator element is form-fitted into the air outlet.

17. The automobile according to claim 10, wherein the resonator element includes a passage configured to receive a sensor.

18. The automobile according to claim 10, further comprising a sensor introduced through the air outlet and the resonator element into a flow path of the air outlet.

* * * * *